US007006777B2

(12) United States Patent
Tsunoda et al.

(10) Patent No.: US 7,006,777 B2
(45) Date of Patent: Feb. 28, 2006

(54) TONER RESERVOIR, PROCESS CARTRIDGE, AND IMAGE FORMING APPARATUS

(75) Inventors: Arihiro Tsunoda, Tokyo (JP); Masayuki Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 70 days.

(21) Appl. No.: 10/674,635

(22) Filed: Sep. 29, 2003

(65) Prior Publication Data

US 2004/0062572 A1 Apr. 1, 2004

(30) Foreign Application Priority Data

Sep. 30, 2002 (JP) ..... 2002-286319

(51) Int. Cl.
*G03G 15/08* (2006.01)

(52) U.S. Cl. ..... 399/252; 399/111; 399/262

(58) Field of Classification Search ..... 399/107, 399/111, 119, 120, 252, 262, 263
See application file for complete search history.

(56) References Cited

U.S. PATENT DOCUMENTS 5,956,556 A 9/1999 Nakajima et al.
5,991,571 A * 11/1999 Yamada et al. ..... 399/117

FOREIGN PATENT DOCUMENTS

JP 2000-181224 6/2000

* cited by examiner

*Primary Examiner*—Hoan Tran
(74) *Attorney, Agent, or Firm*—Akin Gump Strauss Hauer & Feld, LLP

(57) ABSTRACT

A toner reservoir includes a toner chamber that holds toner therein, a shaft disposed within the toner chamber, and a rotating body. The shaft has a groove formed in an outer circumferential surface thereof. The groove extends substantially in a first direction in which the shaft extends. The groove has opposing walls that define a tapered width of the groove such that the width becomes wider nearer an end of the shaft. The rotating body has a wall that projects from rotating body in a second direction parallel to the first direction. The wall may be a hollow cylinder having a plurality of grooves that are formed in its inner surface and extend parallel to the shaft. The wall may include a plurality of walls angularly spaced apart and in contact with the shaft to rotatably hold the shaft.

24 Claims, 13 Drawing Sheets

TONER RESERVOIR, PROCESS CARTRIDGE, AND IMAGE FORMING APPARATUS

BACKGROUND OF THE INVENTION

1. Field of the Invention

The present invention relates to a toner reservoir, a process cartridge, and a developing apparatus.

2. Description of the Related Art

Conventionally, a toner-supplying belt is received in a groove formed in a side frame. The toner-supplying belt is driven to run along the groove, thereby transporting toner.

FIG. 20 is a side view of a conventional process cartridge.

Referring to FIG. 20, a print process cartridge 34 includes a photoconductive drum 19, a charging unit, not shown, a developing unit 65, and a recycling unit. The photoconductive drum 19 is driven in rotation by a drum motor, not shown, and bears a toner image thereon. The charging unit is disposed to oppose and charge the surface of photoconductive drum 19 uniformly before an electrostatic latent image is formed on the surface. The developing unit 65 deposits toner, not shown, to an electrostatic latent image formed on the surface of the photoconductive drum 19, thereby developing an electrostatic latent image on the into a toner image. The recycling unit removes residual toner from the surface of the photoconductive drum 19 after transferring and sends the residual toner back to the developing unit 65. The developing unit 65 includes, for example, a developing roller 21 and a toner-supplying roller 67. The developing roller 21 is disposed to oppose the photoconductive drum 19 while the toner-supplying roller 67 supplies the toner to the developing roller 21.

A developing apparatus is constructed of the developing unit 65 and recycling unit, and functions as a toner reservoir.

The recycling unit includes a cleaning section 66, a toner-collecting chamber 71, and a groove 35 that is formed in a side frame to describe a loop. The cleaning section 66 includes a blade 37*a*, a residual toner chamber 66*a*, and a screw conveyor 38 for collecting toner. The blade scrapes the residual toner of the surface of the photoconductive drum 19. The residual toner chamber 66*a* extends along an axis of the photoconductive drum 19 and holds the residual toner therein. The screw conveyor 38 transports the residual toner collected in the toner chamber 66*a* to the print process cartridge 34.

The groove 35 runs beside, for example, the shafts of the photoconductive drum 19, developing roller 21, and toner supplying roller 67, which cooperate in a printing operation performed in the print process cartridge 34. The groove 35 receives an endless toner-transporting belt 36 having a loop length slightly longer than an inner loop length of the groove 35. A motor, not shown, drives a drive gear 39 to rotate in a direction shown by arrow A. The drive gear 39 in turn drives a driven gear 82 to rotate in a direction shown by arrow B. As a result, the toner-transporting belt 36 is driven to run in the groove 35 in a direction shown by arrow C. The side frame 10 has a substantially U-shaped space that is formed at an upper portion thereof and accommodates a pulley 79 therein. The pulley 79 receives the toner-transporting belt 36 to facilitate smooth running of the toner transporting belt 36.

The groove 35 communicates with one end of the residual toner chamber 66*a* at a toner receiving port P1. The toner transporting belt 36 is partially exposed in the residual toner chamber 66*a*, so that the toner-transporting belt 36 receives the residual toner held in the residual toner chamber 66*a* and transports the residual toner in the C direction. The toner-transporting belt 36 has a plurality of projections 36*a*. A toner receiving recess is defined between adjacent projections 36*a*.

The groove 35 communicates with the toner-collecting chamber 71 at a toner discharging port P2 where the toner-transporting belt 36 is exposed in the toner-collecting chamber 71 to allow the residual toner to fall into the toner-collecting chamber 71. A screw conveyor 40 extends through the toner-collecting chamber 71 and delivers the residual toner back to a toner cartridge.

A gear 73 is attached to the screw conveyor 40 and is in mesh with the toner-transporting belt 36. As the toner-transporting belt 36 runs, the gear 73 is rotated so that the screw conveyor 40 rotates. The screw conveyor 40 has spiral vanes formed thereon, the vanes transporting the residual toner from the side frame 10 to a waste toner chamber in the toner cartridge (reference is made to Japanese Patent Laid-Open No. 2001-18224).

The driven gear 72 is in mesh with the projections 36*a* formed on the toner-transporting belt 36, so that the rotational force of the driven gear 72 causes the toner-transporting belt 36 to run to transport the residual toner.

The structure for rotatably supporting the gear 72 will be described.

FIG. 21 is a side view of a shaft-supporting structure for a conventional belt-driving gear.

FIG. 22 is a perspective view.

FIG. 23 is an exploded view.

FIG. 24 is a front view.

FIG. 25 is a cross-sectional view taken along line A—A of FIG. 24.

Referring to the figures, a shaft 75 is mounted on the side frame 10 and supports the gear 72 in such a way that gear 72 rotates frictionally slidably on the shaft 75. The gear 72 is in the shape of a large-diameter gear section with gear teeth formed in its circumferential surface and has small-diameter bosses 77 and 78 that project in opposite directions from the gear section. The shaft 75 includes a large-diameter portion 75*a* and a small-diameter portion 75*b*. The large-diameter portion 75*a* has a circular cross-section and is mounted on the side frame 10 while the small-diameter portion 75*b* fits into the hole 80.

There is a gap between the outer surface of the small-diameter portion 75*b* and the inner circumferential surface of the gear 72. The gear 72 rotates frictionally slidably rotate on the shaft 75.

A cover, not shown, is attached to the side frame 10 to prevent the residual toner in the groove 35 (FIG. 20) from leaking. Upon mounting the cover to the side frame 10, the cover abuts the end of the boss 77 to prevent the gear 72 pulling out from the shaft 75.

However, with the aforementioned conventional print process cartridge, as the toner-transporting belt 36 runs, the residual toner held in the recess between adjacent projections 36*a* is supplied to the gear 72, entering gaps between the shaft 75 and the gear 72. As a result, the gear 72 cannot be rotated smoothly.

SUMMARY OF THE INVENTION

An object of the invention is to solve the drawbacks of the aforementioned print process cartridge.

Another object of the invention is to provide a toner reservoir and a developing apparatus in which rotating members can smoothly rotate.

A toner reservoir includes a toner chamber that holds toner therein, a shaft disposed within the toner chamber, and a bearing member. The shaft has a groove formed in an outer circumferential surface of the shaft, the groove extending substantially in a first direction in which the shaft extends. The bearing member engages the shaft so that the shaft and the bearing member can rotate relative to each other. The bearing member has a projection that projects from the bearing member in a second direction parallel to the first direction, the projection having a surface in contact with the shaft such that the projection rotatably holds the shaft.

The shaft is stationary and the bearing member rotatably rotates on the shaft.

The bearing member is stationary and the shaft rotatably rotates on the bearing member.

The wall may include a plurality of walls angularly spaced apart and in contact with the shaft such that the rotating body is rotatably supported on the shaft.

The wall may be a hollow cylinder having a groove formed in the inner surface of the wall and extending substantially in a third direction parallel to the first direction The walls are present over a total angle in the range of 30 to 70% of 360° with respect to the shaft and absent over a total angle in the range of 70 to 30% of 360° with respect to the shaft.

The groove has opposing walls that extend at an angle with the first direction, the opposing walls defining a tapered width of the groove such that the width becomes wider nearer an end of the shaft.

The opposing walls make the angle not smaller than 11.3° with each other.

The shaft includes a small-diameter portion and a large-diameter portion, the small-diameter portion supporting the rotating body thereon.

A toner reservoir includes a toner chamber that holds toner therein, a shaft disposed within the toner chamber, a rotating body rotatably supported on the shaft; and a resilient sleeve. The resilient sleeve encloses the rotating body and the shaft in such a way that the rotating body is rotatable on the shaft.

The resilient sleeve is made of a foamed material.

The foamed material is a closed-cell material.

The foamed material has a hardness in the range of 20 to 90° ISO

A process cartridge detachably is mounted to an image forming apparatus. The process cartridge includes a developing unit that supplies toner to an electrostatic latent image formed on an image bearing body to form a toner image. The process cartridge includes a shaft disposed within the toner chamber and a rotating body having walls that project from the rotating body in a second direction parallel to the first direction. The shaft has a groove formed therein, the groove extending substantially in a first direction in which the shaft extends. The walls are angularly spaced apart and in contact with the shaft such that the rotating body is rotatably supported on the shaft.

The walls are present over a total angle in the range of 30 to 70% of 360° with respect to the shaft and absent over a total angle in the range of 70 to 30% of 360°.

The groove includes opposing walls that extend at an angle with the first direction, the opposing walls defining a tapered width of the groove such that the width becomes wider nearer an end of the shaft.

The opposing walls make an angle not smaller than 11.3° with each other.

The shaft includes a small-diameter portion and a large-diameter portion, the small-diameter portion supporting the rotating body thereon.

A process cartridge detachably is mounted to an image forming apparatus. The process cartridge includes a developing unit that supplies toner to an electrostatic latent image formed on an image bearing body to form a toner image. The process cartridge includes a toner chamber that holds toner therein, a shaft disposed within a toner chamber, a rotating body rotatably supported on the shaft; and a resilient sleeve. The resilient sleeve encloses the shaft and a part of the rotating body in such a way that the rotating body is rotatable on the shaft.

The resilient sleeve is made of a foamed material.

The foamed material is a closed-cell material.

The resilient sleeve has a hardness in the range of 20 to 90° ISO.

An image-forming apparatus includes the aforementioned process cartridge and forms an image through an image forming process.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description, given hereinbelow and the accompanying drawings which are given by way of illustration only, and thus are not limiting the present invention, and wherein.

DETAILED DESCRIPTION OF THE INVENTION

First Embodiment

Figure 1:
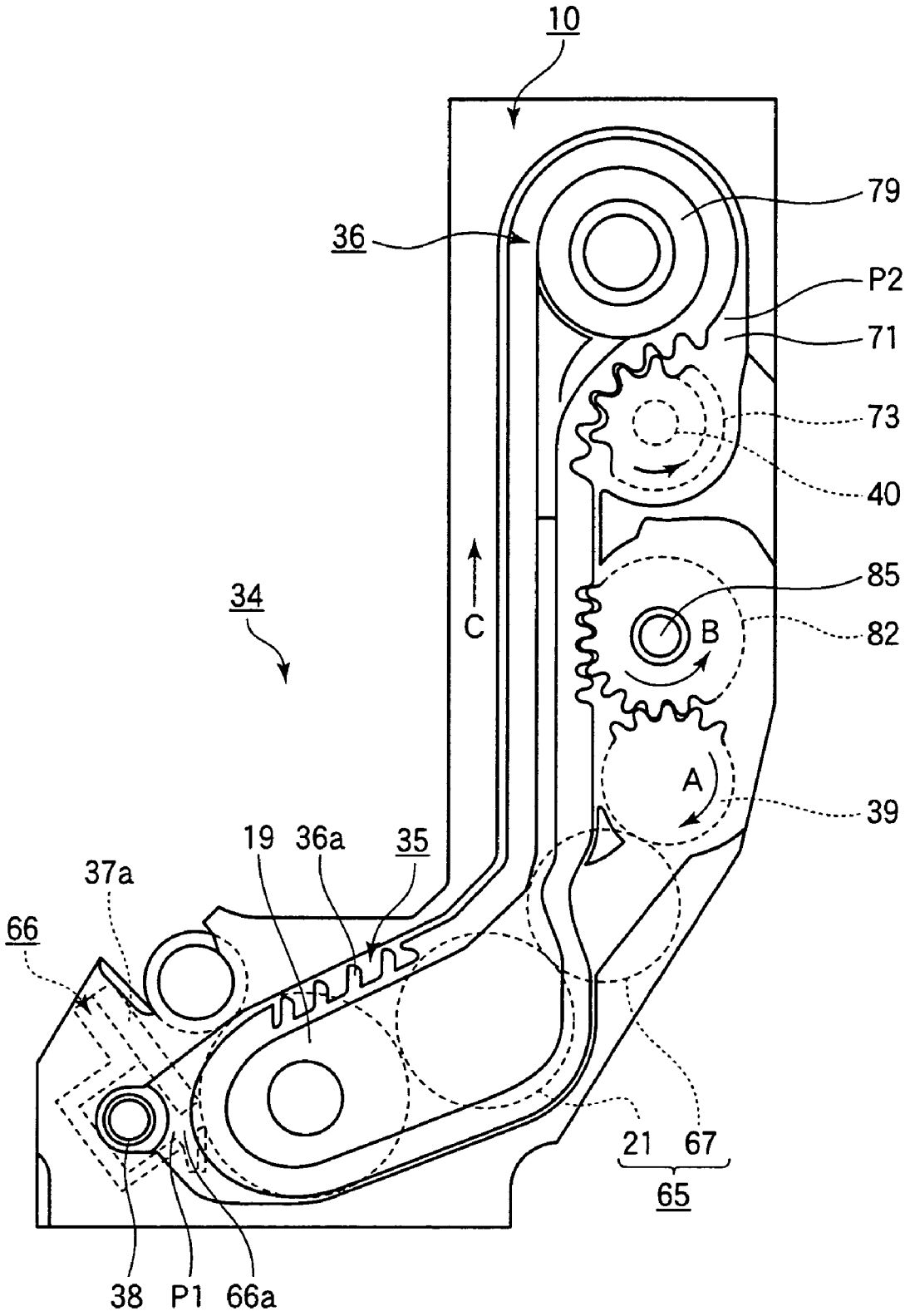
FIG. 1 is a side view of a print process cartridge according to the invention.

FIG. 1 is a side view of a print process cartridge according to the invention.

Figure 2:
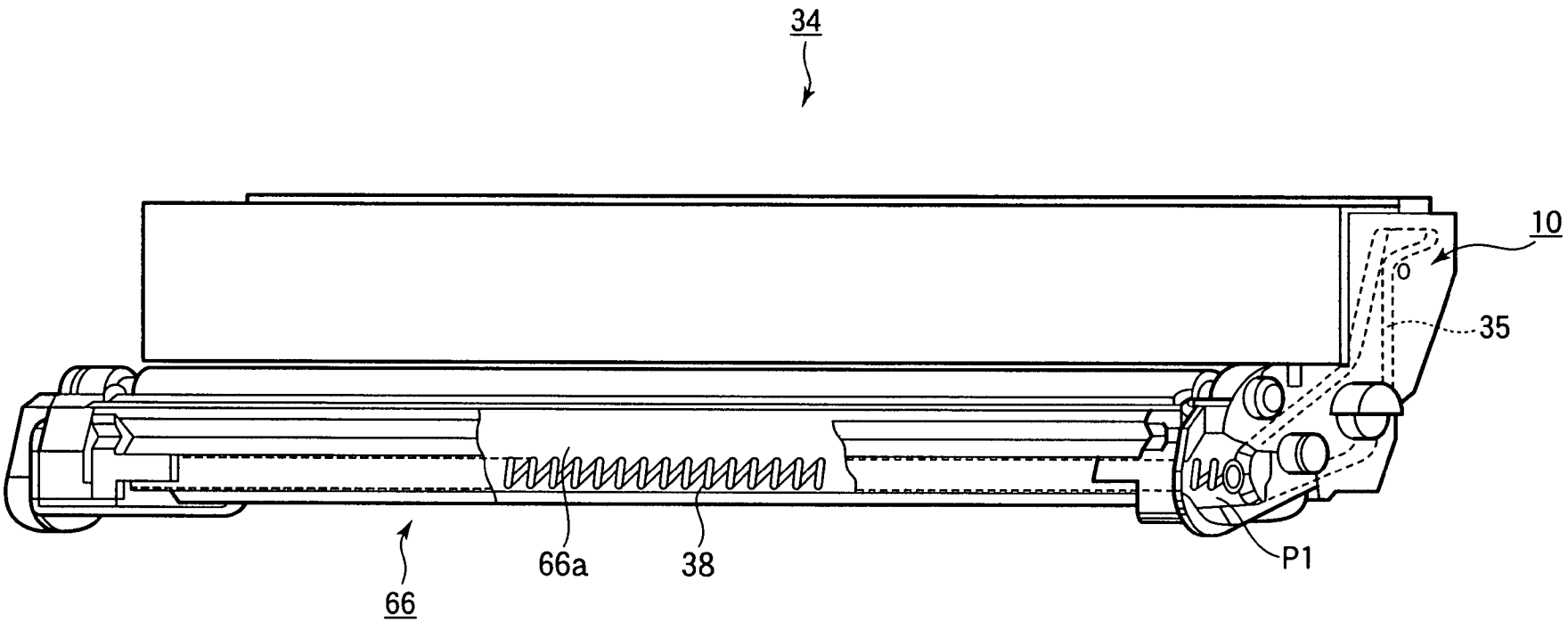
FIG. 2 is a perspective view of the print process cartridge of the FIG. 1.

FIG. 2 is a perspective view of the print process cartridge of the FIG. 1.

Referring to FIG. 1, a print process cartridge 34 includes a photoconductive drum 19, a charging unit, not shown, a developing unit 65, and a recycling unit. The photoconductive drum 19 is driven in rotation by a drum motor, not shown, and bears an image on its surface. The charging unit is disposed to oppose and charge the surface of photoconductive drum 19 uniformly. The developing unit 65 deposits toner, not shown, to an electrostatic latent image formed on the surface of the photoconductive drum 19, thereby developing the electrostatic latent image into a toner image. The recycling unit removes residual toner from the surface of the photoconductive drum 19 after transfer of the toner image and sends the residual toner back to the developing unit 65 for reuse. The developing unit 65 includes, for example, a developing roller 21 and a toner-supplying roller 67. The developing roller 21 is disposed to oppose the photoconductive drum 19 while the toner-supplying roller 67 supplies toner to the developing roller 21.

A developing apparatus is constructed of the developing unit 65 and the recycling unit and functions as a toner reservoir.

The recycling unit includes a cleaning section 66, a toner-collecting chamber 71, and a groove 35 that is formed in a side frame to describe a loop. The cleaning section 66 includes a blade 37*a*, a residual toner chamber 66*a*, and a screw conveyor 38 (see also FIG. 2). The blade scrapes the residual toner off the surface of the photoconductive drum 19. The residual toner chamber 66*a* extends along an axis of the photoconductive drum 19 and holds the residual toner therein. The screw conveyor 38 transports the residual toner collected in the toner chamber 66*a* to the print process cartridge 34.

The groove 35 runs beside the shafts of the photoconductive drum 19, developing roller 21, and toner supplying roller 67, which cooperate in a printing operation performed in the print process cartridge 34. The groove 35 receives the endless toner-transporting belt 36 having a loop length slightly longer than an inner loop length of the groove 35. A motor, not shown, drives a drive gear 39 to rotate in a direction shown by arrow A. The drive gear 39 drives a driven gear 82 to rotate in a direction shown by arrow B. As a result, the toner-transporting belt 36 is driven to run in a direction shown by arrow C along the groove 35. The side frame 10 has a substantially U-shaped space formed at an upper portion thereof, the U-shaped space accommodating a pulley 79 therein. The pulley 79 receives the toner-transporting belt 36 to facilitate smooth running of the toner-transporting belt 36.

The groove 35 communicates with one end of the residual toner chamber 661 at a toner receiving port P1. The toner-transporting belt 36 is partially exposed in the residual toner chamber 66*a*, so that the toner-transporting belt 36 receives the residual toner held in the residual toner chamber 66*a* and transports the residual toner in the C direction. The toner-transporting belt 36 has a plurality of projections 36*a*. A toner receiving recess is defined between adjacent projections 36*a*.

The groove 35 communicates with the toner-collecting chamber 71 at a toner discharging port P2 where the toner-transporting belt 36 is exposed in the toner-collecting chamber 71 to allow the residual toner to fall into the toner-collecting chamber 71. A screw conveyor 40 extends through the toner-collecting chamber 71 and delivers the residual toner back to a toner cartridge.

A gear 73 is attached to the screw conveyor 40 and is in mesh with the toner-transporting belt 36. As the toner-transporting belt 36 runs, the gear 73 is rotated so that the screw conveyor 40 rotates. The screw conveyor 40 has spiral vanes formed thereon, the vanes transporting the residual toner from the side frame 10 to a waste toner chamber in the toner cartridge.

The driven gear 82 is in mesh with the projections 36*a* formed on the toner-transporting belt 36, so that the rotational force of the driven gear 82 causes the toner-transporting belt 36 to run to transport the residual toner.

There is a problem that as the toner-transporting belt 36 runs, the residual toner held in the recess formed between adjacent projections 36*a* is supplied to the gear 82, possibly entering gaps between a shaft 85 and the gear 82.

When the toner in the gaps is constantly rubbed between the shaft 85 and the gear 82, the friction heat may cause "filming" on the shaft 85 and the inner circumferential surface of the gear 82. Filming disturbs smooth rotation of the gear 82 and causes jittering in printed images.

A shaft-supporting mechanism for the gear 82 will be described where the toner in the gaps is not rubbed between the shaft 85 and the gear 82.

Figure 3:
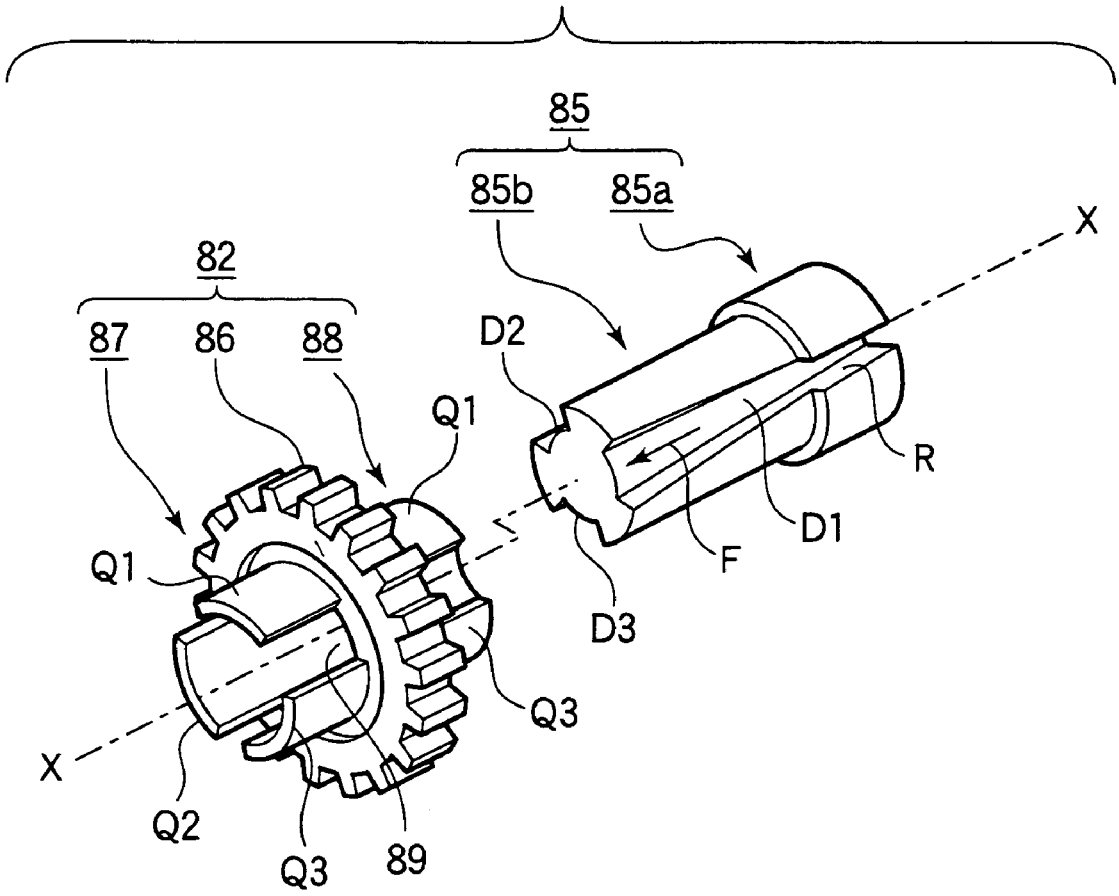
FIG. 3 is an exploded view illustrating the shaft-supporting structure according to the first embodiment.

FIG. 3 is an exploded view, illustrating the shaft-supporting structure according to the first embodiment.

Figure 4:
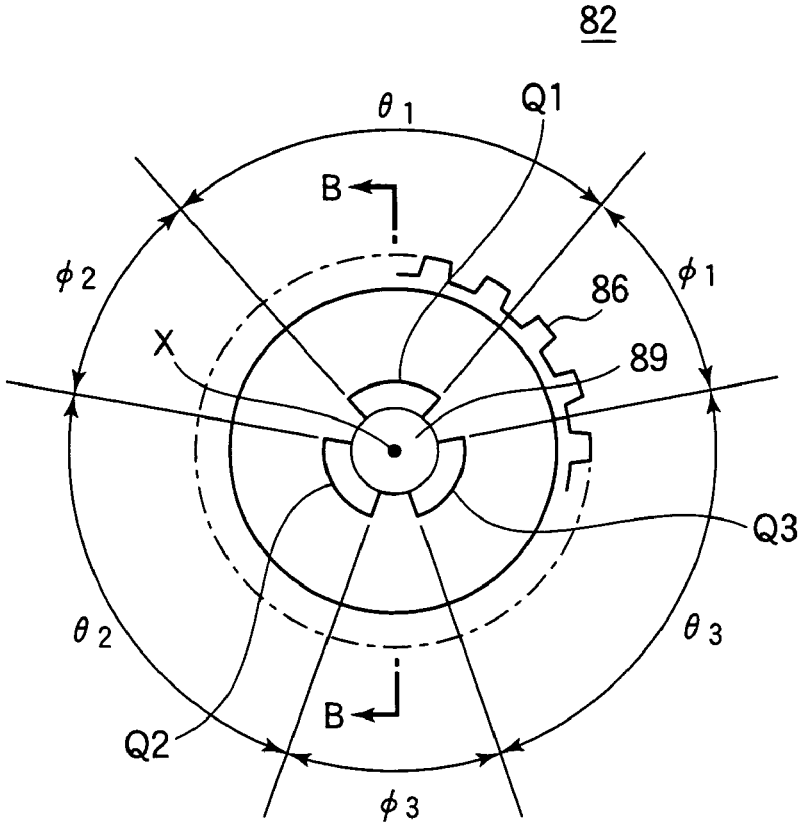
FIG. 4 is a front view of the gear.

FIG. 4 is a front view of the gear.

Figure 5:
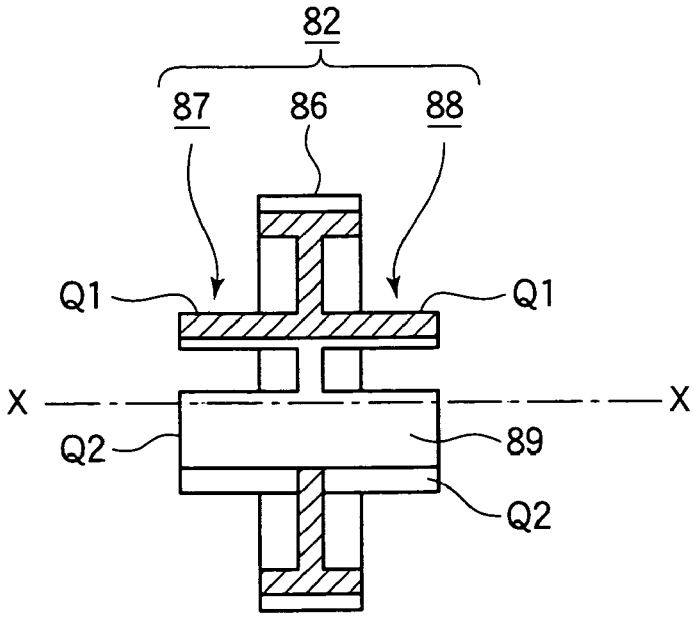
FIG. 5 is a cross-sectional view taken along line B—B of FIG. 4.

FIG. 5 is a cross-sectional view taken along line B—B of FIG. 4.

The shaft 85 is mounted on the side frame 10 and supports the gear 82 in such a way that the gear 82 rotates frictionally slidably on the shaft 85. The gear 82 has a large-diameter section 86 with gear teeth formed in its outer circumferential surface and has small-diameter bosses 87 and 88 that project in opposite directions from the gear section 86 and are in line with the gear section 86. The gear 82 has an axial hole 89 that extends through the gear 82 and the small-diameter bosses 87 and 88.

Each of the bosses 87 and 88 includes three arcuate walls Q1–Q3 that are angularly spaced at substantially equal intervals. The arcuate wall extends over angles θ1, θ2, and θ3 and the arcuate wall is absent over angles ϕ1, ϕ2, and ϕ3. The gear section 86 has 20 teeth having a size of M1

(module 1), a width (length of teeth in an axial direction) of 5 mm, and an average thickness (i.e., thickness in the axial direction) of about 1 mm.

Figure 6:
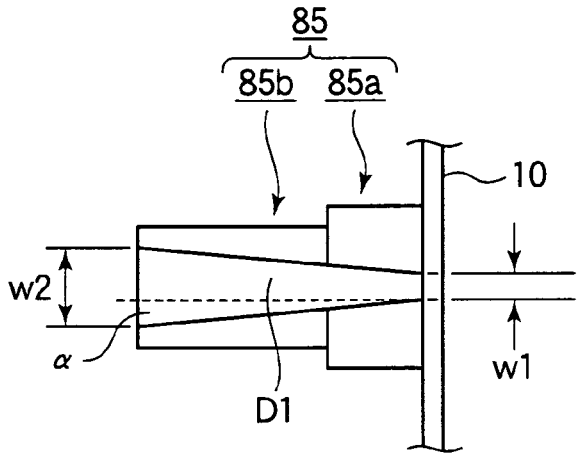
FIG. 6 is a side view of the shaft mounted on the side frame.

FIG. 6 is a side view of the shaft mounted on the side frame.

The shaft 85 includes a large-diameter portion 85*a* and a small-diameter portion 85*b*. The large-diameter portion 85*a* has a circular cross section and is mounted to the side frame 10. The small-diameter portion 85*b* fits into the hole 89 and serves as a supporting element that supports the gear 82. The shaft 85 has three grooves D1–D3 formed therein that extend along the small-diameter portion 85*b* and the large-diameter portion 85*a*. The grooves D1–D3 are angularly spaced at substantially equal intervals. Each of the grooves D1–D3 is tapered by an angle α so that the width of the groove becomes wider nearer the free end of the small-diameter portion 85*b*. The groove has a width W1 at a free end of the large-diameter portion 85*a* and a width W2 at a free end of the small-diameter portion 85*b*. The widths W1 and W2 are in the relation that W2>W1.

Upon assembly, the small-diameter portion 85*b* of the shaft 85 extends through the hole 89 so that the gear 82 can rotate frictionally slidably on the shaft 85.

A cover, not shown, is attached to the side frame 10 to prevent the residual toner in the groove 35 (FIG. 5) from leaking. Upon mounting the cover to the side frame 10, the cover abuts the free end of the boss 87 to prevent the gear 82 from pulling out from the shaft 85.

Only the circumferential surfaces of the small-diameter portion 85*b* contact the inner circumferential surface of the gear section 86 that defines the hole 89 and the inner surfaces of the arcuate walls Q1–Q3.

Because the grooves D1–D3 are formed in the circumferential surface of the small-diameter portion 85*b*, the area of the small-diameter portion 85*b* in contact with the inner circumferential surface of the gear 82 can be small, thereby minimizing the chance of toner entering between the gear 82 and the shaft 85. The residual toner enters the gaps between the gear 82 and shaft 85 and then advances into the grooves D1–D3. Thus, the residual toner is not rubbed between the gear 82 and shaft 85. The structure prevents filming from occurring, so that the gear 82 can smoothly rotate to prevent, for example, jittering of printed images.

The arcuate walls Q1–Q3 project in opposite directions from the gear section 86, and are aligned angularly at substantially equal intervals. This is advantageous in that even when the difference in dimensional errors between the inner circumferential surface of the gear 82 and the outer diameter of the small-diameter portion 85*b* becomes large, the arcuate walls prevents the gear 82 from inclining by a large angle. In order to minimize the inclination of the gear 82, the total angle over which the arcuate wall is absent should be in the range of 108 to 252° with respect to the axis X. Additionally, the arcuate walls Q1–Q3 are equally angularly spaced by 120°, maximizing the mechanical strength of the gear 82 and the ability of the arcuate walls to grasp the small-diameter portion 85*b* of the shaft 85.

The grooves D1–D3 have a tapered width such that the width W2 is greater than the width W1. Therefore, the toner that has entered into the grooves D1–D3 advances on the side wall R in a direction shown by arrow F (i.e., direction away from the side frame 10) and drops from the grooves D1–D3 to be subsequently collected.

As described above, the grooves D1–D3 define a path for residual toner between the shaft 85 and the gear 82, preventing filming.

The operation of the aforementioned supporting structure will be described.

Figure 7:
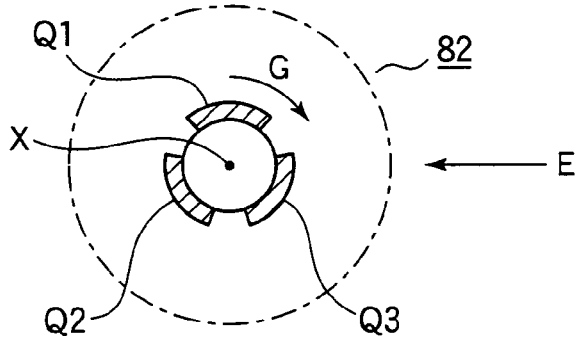
FIG. 7 is a front view of the gear, illustrating a rotational position of the gear.

FIG. 7 is a front view of the gear 82, illustrating a rotational position of the gear 82.

Figure 8:
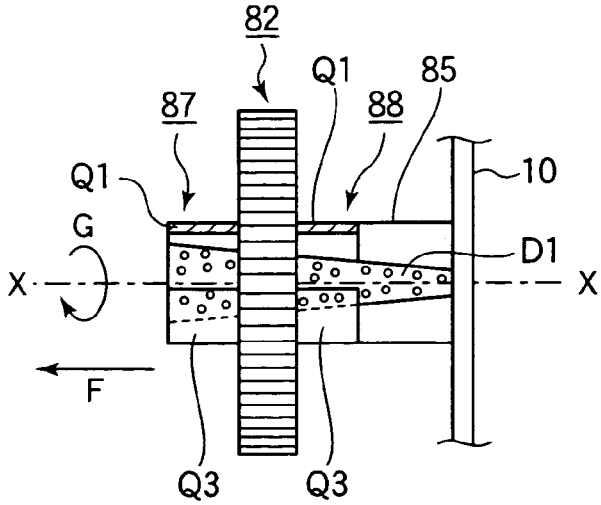
FIG. 8 is a side view of the gear and shaft with a cross-sectional view in part as seen in a direction shown by arrow E in FIG. 7.

FIG. 8 is a side view of the gear 82 and shaft 85 with a cross-sectional view in part as seen in a direction shown by arrow E in FIG. 7.

When the gear 82 rotates in a direction shown by arrow G in FIG. 7, the shaft 85 is subjected to mechanical vibration. Because the grooves D1–D3 (FIG. 1) are tapered so that the groove becomes wider nearer the free end of the small-diameter portion 85*b*, the residual toner in the grooves D1–D3 slides on the wall R away from the side frame 10.

Figure 9:
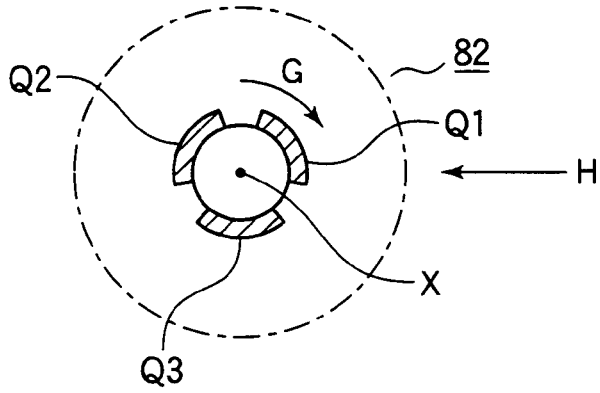
FIG. 9 is a front view of the gear, illustrating another rotational position of the gear.

FIG. 9 is a front view of the gear, illustrating another rotational position of the gear 82.

Figure 10:
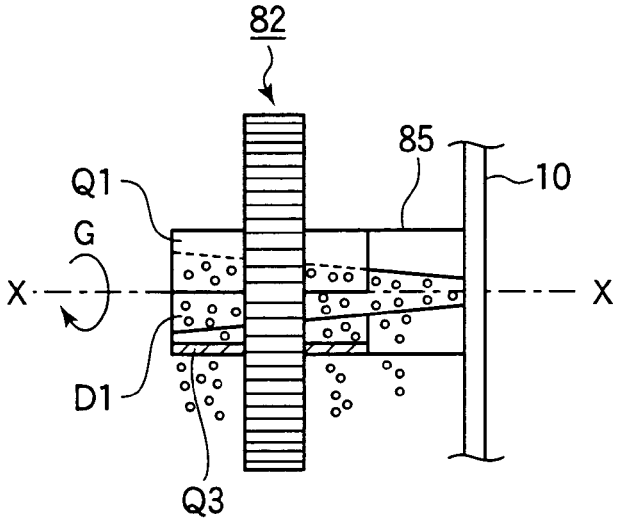
FIG. 10 is a side view of the gear and shaft with a cross-sectional view in part as seen in a direction shown by arrow H in FIG. 9.

FIG. 10 is a side view of the gear 82 and shaft 85 with a cross-sectional view in part as seen in a direction shown by arrow H in FIG. 9.

When gear 82 rotates further in the G direction as shown in FIG. 9, the residual toner moves from the large-diameter portion 85*a* toward the free end of the small-diameter portion 85*b*, so that about half the toner in the grooves D1–D3 will drop from the grooves with the aid of the arcuate walls Q1–Q3. Then, the toner remaining in the grooves advances through the small-diameter portion 85*b* in a direction shown by arrow F, and some of the toner drops from the grooves with aid of the arcuate walls Q1–Q3 of the boss 88. Then, the toner still advances through the grooves in the small-diameter portion 85*b*, and some of the toner drops from the grooves with the aid of the arcuate walls Q1–Q3 of the boss 87.

Figure 11:
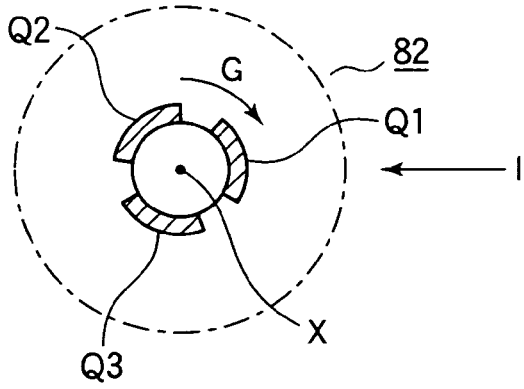
FIG. 11 is a front view of the gear.

FIG. 11 is a front view of the gear.

Figure 12:
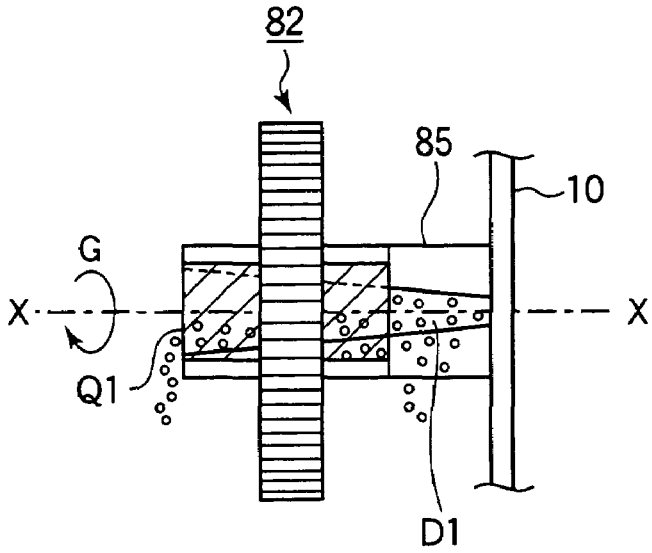
FIG. 12 is a side view of the gear and shaft with a cross-sectional view in part as seen in a direction shown by arrow I in FIG. 11.

FIG. 12 is a side view of the gear and shaft with a cross-sectional view in part as seen in a direction shown by arrow I in FIG. 11.

When gear 82 rotates still further in the G direction as shown in FIG. 11, the toner drops from the grooves. The rest of the residual toner finally reaches the end of the grooves D1–D3 and falls from the grooves D1–D3 as shown in FIG. 12.

In the aforementioned manner, the residual toner in the grooves D1–D3 is discharged at a plurality of locations along the small-diameter portion 85*b*. The residual toner in the grooves D1–D3 is in contact with the inner circumferential surface of the gear 82. The residual toner in the grooves D1–D3 tends to move in the G direction due to friction while at the same time the side wall R guides the residual toner to move in the F direction (FIG. 1), so that the residual toner is discharged eventually from the grooves D1–D3.

For different ranges of angle over which the arcuate wall is absent, Table 1 lists the mechanical strength of the arcuate walls and force of the arcuate walls that grasps the shaft 85, occurrence of filming, and increase in torque required for rotating the gear 82.

TABLE 1

| total angle over which the arcuate wall is absent (degree) | mechanical strength and grasping force | occurrence of filming | increase in torque (g-cm) |
|---|---|---|---|
| 252–360 | poor | excellent | ≦10 |
| 108–252 | excellent | good | ≦50 |
| 360–108 | excellent | poor | ≦100 |

When the total angle over which the arcuate wall is absent is 360°, the arcuate walls Q1–Q3 are not formed actually and the gear 82 has only the gear section 86 with gear teeth formed in its outer circumferential surface. Occurrence of filming was examined as follows: A continuous printing job of 26,000 pages (9,000 pages at room temperature, 9,000 pages at high temperature and high humidity, and 8,000 at low temperature and low humidity) was performed at a print duty cycle of 5%.

When the arcuate wall is absent over a total angle in the range of 252–360°, the mechanical strength and grasping force of the arcuate walls Q1–Q3 are small (poor), therefore filming does not occur (excellent), and an increase in torque required for rotating the gear 82 is not more than 10 g-cm. When the arcuate wall is absent over a total angle in the range of 108–252°, the mechanical strength and grasping force of the arcuate walls Q1–Q3 are enough (excellent), therefore some filming occur (excellent), and an increase in torque is not more than 50 g-cm. At this moment, the gear 82 is free from fluctuation of rotation so that the toner-transporting belt 36 runs smoothly. For a continuous printing operation of 26,000, no fluctuation of rotation could be detected. When the arcuate wall is absent over a total angle in the range of 360–108°, the mechanical strength and grasping force of the arcuate walls are large (excellent), filming occurs, and fluctuation of the rotation of the gear 82 appears when a large number of pages are printed.

From the data listed in Table 1, the total angle over which the arcuate wall is absent is preferably in the range of 108 to 252°

Table 2 lists the angle by which the groove is tapered, and occurrence of filming, for different dimensions of the groove (i.e., W1 and W2).

TABLE 2

| W1 × W2 (mm) | occurrence of filming | angle α by which groove is tapered(°) |
|---|---|---|
| 2 × 2 | poor | 0 |
| 2 × 3 | good | 5.7 |
| 2 × 4 | good | 11.3 |
| 2 × 5 | excellent | 16.7 |

The large diameter-portion 85*a* and the small-diameter portion 85*b* of the shaft 85 were designed to have diameters of 8 mm and 5 mm, respectively. The widths W1 and W2 of the groove were selected to be 2 mm and 2–5 mm, respectively. The circumferential speed of the photoconductive drum 19 was 210 mm/sec and the speed of the toner-transporting belt 36 was in the range of 42 to 84 mm/sec, which is about 20 to 40% of the circumferential speed of the photoconductive drum 19. If the speed of the toner-transporting belt 36 is less than 20% of the circumferential speed of the photoconductive drum 19, then the residual toner cannot be transported fast enough so that the toner will pile up at the toner receiving port P1. If the speed of the toner-transporting belt 36 is 20 to 40% of the circumferential speed of the photoconductive drum 19, then the residual toner can be transported fast enough, improving the ability of the toner-transporting belt 36 to collect the residual toner. If the speed of the toner-transporting belt 36 is higher than 40% of the circumferential speed of the photoconductive drum 19, then the residual toner can be transported fast enough but a larger drive force is required.

When the widths W1 and W2 were selected to be 2 mm and the angle a by which the groove is tapered is 0°, filming occurs. Moreover, the rotation of the gear 82 began to fluctuate with increasing number of printed pages. When the width W1 was selected to be 2 mm, the width W2 was selected to be 3 mm or 4 mm, and the angle by which the groove is tapered is 16.7° or 11.3°, a small amount of filming occurred but the rotation of the gear 82 did not fluctuate so that the toner-transporting belt 36 could run smoothly. No fluctuation of the rotation of the gear 82 was detected up to 26,000 continuously printed pages. When the widths W1 and W2 were selected to be 2 mm and 5 mm, respectively, and the angle α was 16.7, then little or no filming occurred. No fluctuation of the rotation of the gear 82 was detected and the toner-transporting belt 36 ran smoothly. No fluctuation of the rotation of the gear 82 was detected up to 26,000 continuously printed pages.

The larger the angle α, the more effective in discharging the residual toner. When the speed of the toner-transporting belt 36 is 20 to 40% of the circumferential speed of the photoconductive drum 19, the angle α should be larger than 11.3°.

Second Embodiment

In the present embodiment, the residual toner in the grooves D1–D3 is discharged little by little as the gear 82 rotates. The inner circumferential surface of the gear 82 is in continuous contact with the toner in the grooves D1–D3. Thus, if friction heat is generated, filming is likely to occur.

Thus, a second embodiment is featured in that the gear 82 has grooves formed in its inner circumferential surface to reduce an area of the inner circumferential surface in contact with the toner in the grooves D1–D3. Elements similar to those of the first embodiment have been given the same reference numerals and the description thereof is omitted.

Figure 13:
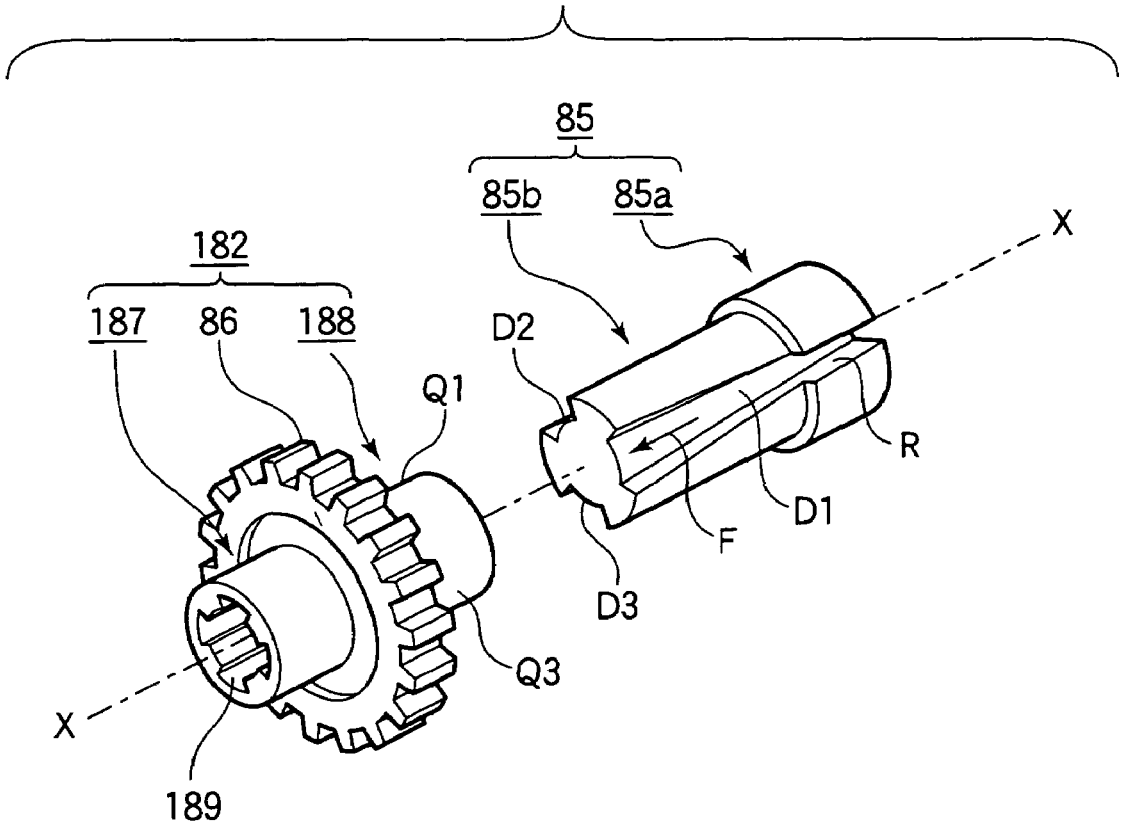
FIG. 13 is an exploded perspective view, illustrating the shaft-supporting structure of the gear.

FIG. 13 is an exploded perspective view, illustrating the shaft-supporting structure of the gear 82.

Figure 14:
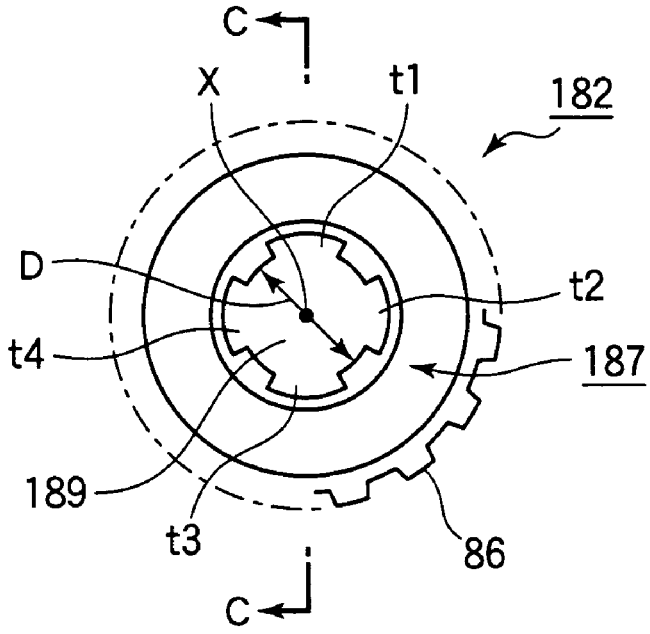
FIG. 14 is a front view of the gear.

FIG. 14 is a front view of the gear 82.

Figure 15:
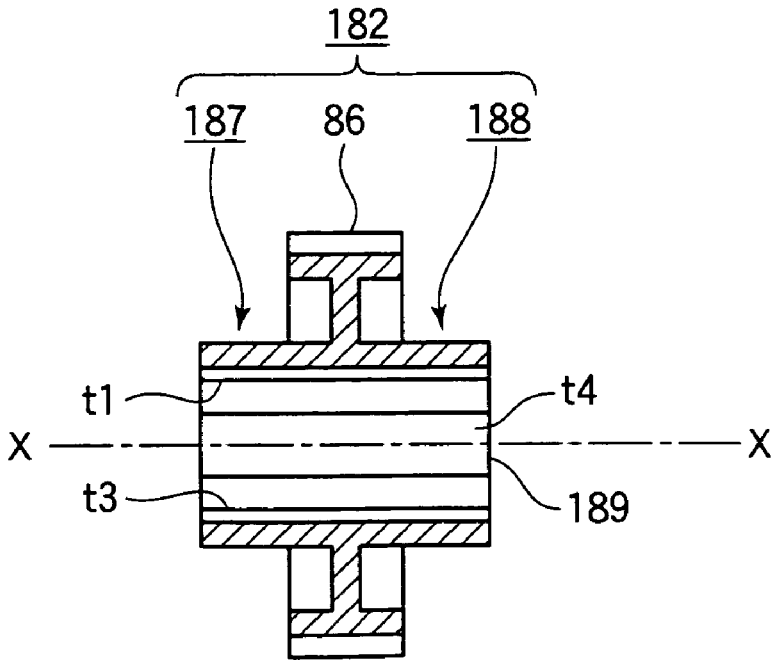
FIG. 15 is a cross-sectional view taken along line C—C of FIG. 14.

FIG. 15 is a cross-sectional view taken along line C—C of FIG. 14.

Referring to the figures, a gear 182 has a gear section 86 with gear teeth formed in its outer circumferential surface. The gear 182 also includes small-diameter bosses 187 and 188 that project in opposite directions from the gear section 86 and are in line with the gear section. There is formed a hole 189 that extends through the gear section 86 and the small-diameter bosses 187 and 188. The inner circumferential surface of the gear 182 is formed with 4 grooves t1–t4 that are angularly disposed at substantially equal intervals. The grooves t1–t4 have a circumferential bottom surface concentric to the small-diameter bosses 187 and 188. The gear section 86 has 20 teeth having a size of M1 (module 1), a gear width of 5 mm (length of the teeth in an axial plane), and an average thickness of about 1 mm. When the gear 82 is molded from a resin material, if there is a large variation in thickness across the entire geometry of the gear 82, the molded part cools down slowly or fast depending on the locations of the molded part to cause mechanical distortion o the molded part. Thus, the gear 82 is designed to have substantially the same thickness across it, so that the molded part can be uniformly cooled. The outer diameter of the bosses 187 and 188 is 8 mm and the diameter D of the inner circumferential surface is 6 mm. The depth of the grooves t1–t4 is 0.5 mm.

The aforementioned four grooves t1–t4 are effective in reducing the area of the inner circumferential surface of the gear 82 in continuous contact with the residual toner. This structure is effective in preventing filming.

Third Embodiment

Figure 16:
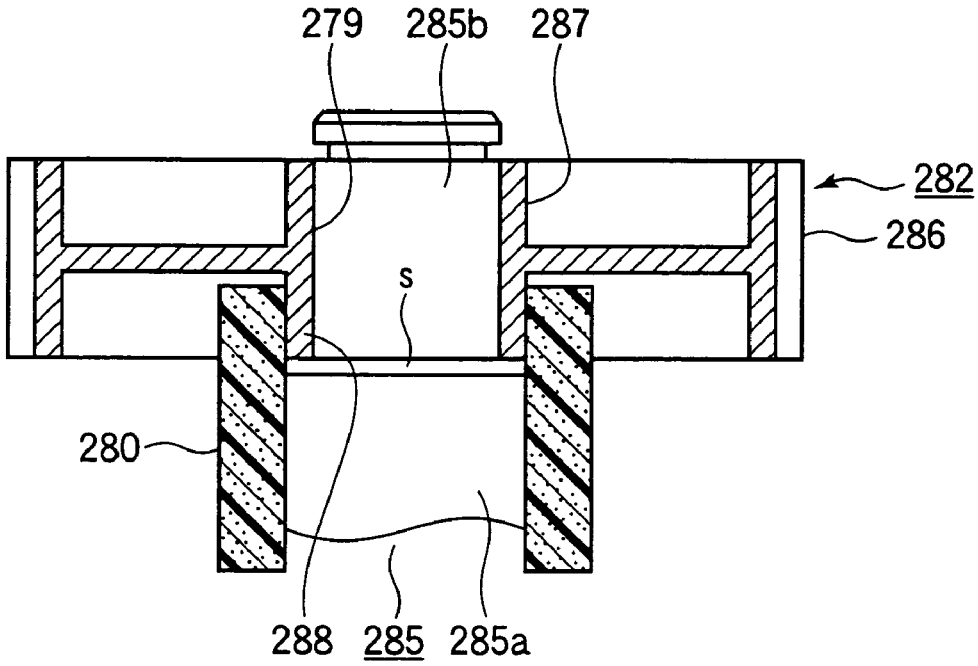
FIG. 16 is a cross sectional view of the gear according to a third embodiment.

FIG. 16 is a cross sectional view of the gear 282 according to a third embodiment.

Referring to FIG. 16, a shaft 285 is supported on the side frame 10 (FIG. 5) and supports the gear 282 in such a way that gear 282 rotates frictionally slidably on the shaft 285. the gear 282 includes a large-diameter gear section 286 with gear teeth formed in its outer circumferential surface and small-diameter bosses 287 and 288 that project in opposite directions from the gear section 286. The gear 282 has a center hole 279 that extends axially through the gear 282.

The shaft 285 has a large-diameter portion 285*a* and a small-diameter portion 285*b*. The large-diameter portion 285*a* is supported on the side frame 10 while the small-diameter portion 285*b* fits into the hole 279. A foamed sleeve 280 fits over the large-diameter portion 285*a* to enclose the boss 288, so that the boss 288 of the gear 282 is in slidable contact with the foamed sleeve 280 and rotates relative to the foamed sleeve 280.

The gear section 286 has 20 teeth having a size of M1 (module 1), and an average thickness of about 1 mm. The outer diameter of the bosses 287 and 288 and the large-diameter portion 285*a* is 8 mm. The outer diameter of the small-diameter portion 285*b* is 6 mm. The tolerance of the diameter of the bosses 287 and 288 is 0/−0.1 mm and the tolerance of the diameter of the large-diameter portion 285*a* is +0.1/0 mm.

The foamed sleeve 280 is made of a closed-cell material and has an inner diameter of 8 mm with a tolerance in the range of −0.05 to −0.2 mm. The thickness of the foamed sleeve 280 is in the range of 2 to 3 mm and is made of a foaming material such as EPDM, urethane, or silicone. The foamed sleeve 280 having too small a thickness is useless because it has not enough rigidity.

The foamed sleeve 280 may be made of an interconnected cell material such as urethane. For an interconnected cell material, one side of the foamed sleeve 280 communicates with the other side. Therefore, the residual toner that enters the outer surface of the foamed sleeve 280 will reach the inner surface of the foamed sleeve 280.

In the embodiment, before the foamed sleeves 280 fits over the large-diameter portion 285*a* and the boss 288, the foamed sleeve 280 has an inner diameter slightly smaller than the outer diameter of the bosses 287 and 288 and the large-diameter portion 285*a* . First, the foamed sleeve 280 fits over the large-diameter portion 285*a* and then the boss 288 fits into the clearance between the foamed sleeve 280 and the small-diameter portion 285*b*, thereby forming a shaft-supporting structure. The front edge of the large-diameter portion 285*a* is chamfered into a surface s, thereby facilitating smooth fitting of the foamed sleeve 280.

As described above, the foamed sleeve 280 covers the boundary portion between the gear 282 and the large-diameter portion 285*a*, thereby preventing the toner from entering the gaps between the gear 282 and the small-diameter portion 285*b*. The foamed sleeve 280 made of a closed-cell material is effective in preventing the toner from passing through the foamed sleeve 280.

The structure according to the third embodiment prevents filming from occurring and the rotation of the gear 282 from fluctuating, thereby allowing the toner-transporting belt 36 to run smoothly and thus preventing jittering to occur in printed images.

Fourth Embodiment

Figure 17:
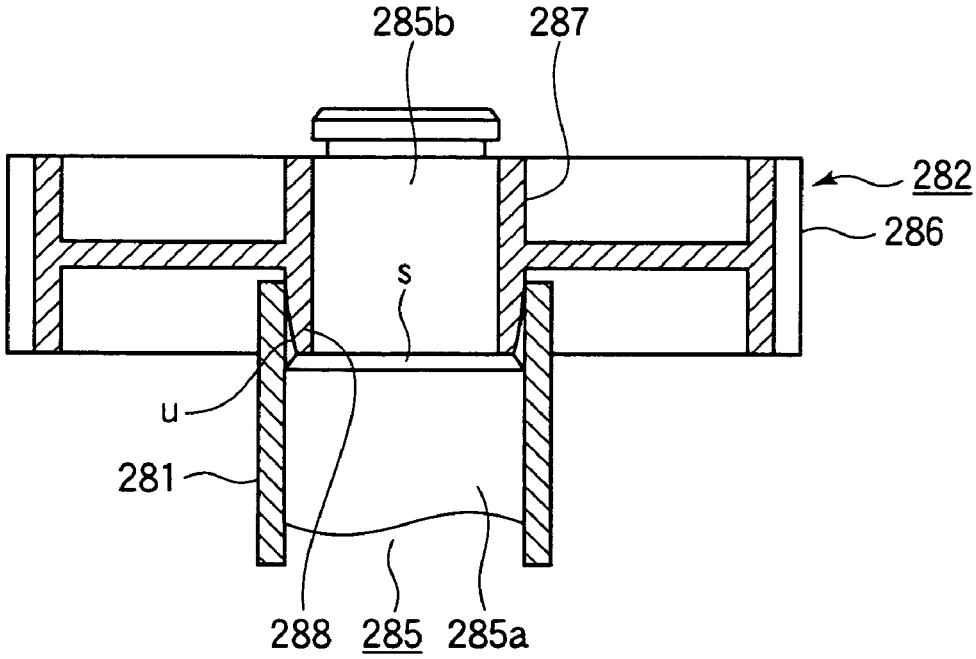
FIG. 17 is a cross-sectional view of a shaft-supporting structure of the gear according to a fourth embodiment.

FIG. 17 is a cross-sectional view of a shaft-supporting structure of the gear according to a fourth embodiment.

Figure 18:
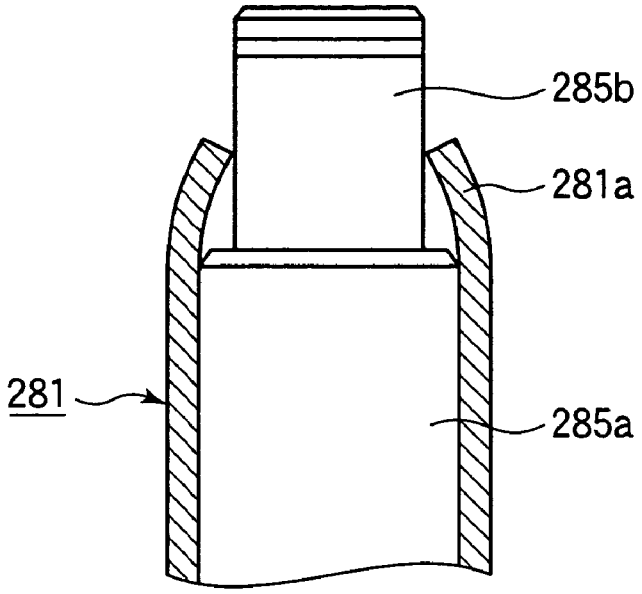
FIG. 18 is a partially cross-sectional view of a resilient sleeve having a low hardness, illustrating the resilient sleeve when it is fitted over the shaft.

FIG. 18 is a partially cross-sectional view of a resilient sleeve having a low hardness, illustrating the resilient sleeve when it is fitted over the shaft.

Figure 19:
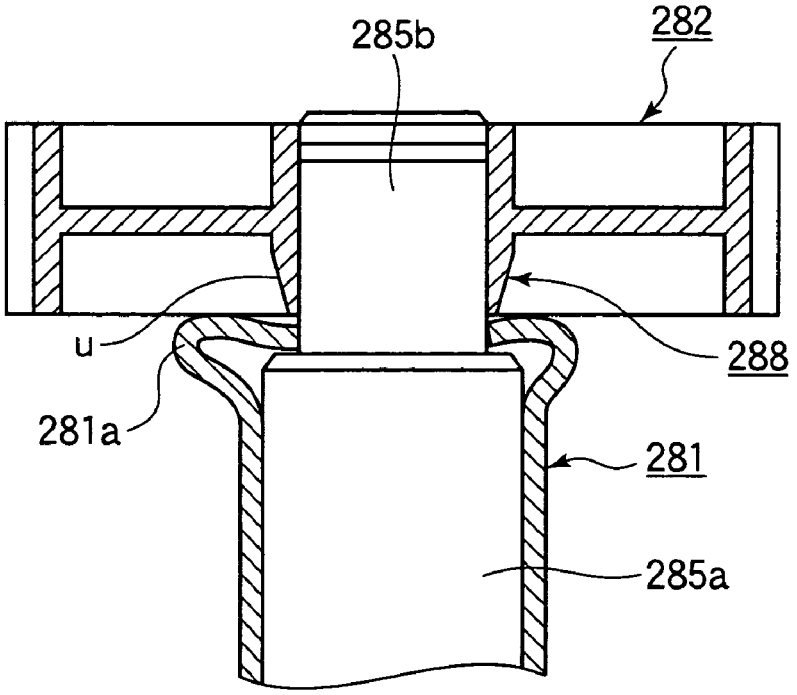
FIG. 19 is a partially cross-sectional view of the resilient sleeve having a low hardness, illustrating the resilient sleeve when it is bent.
Figure 20:
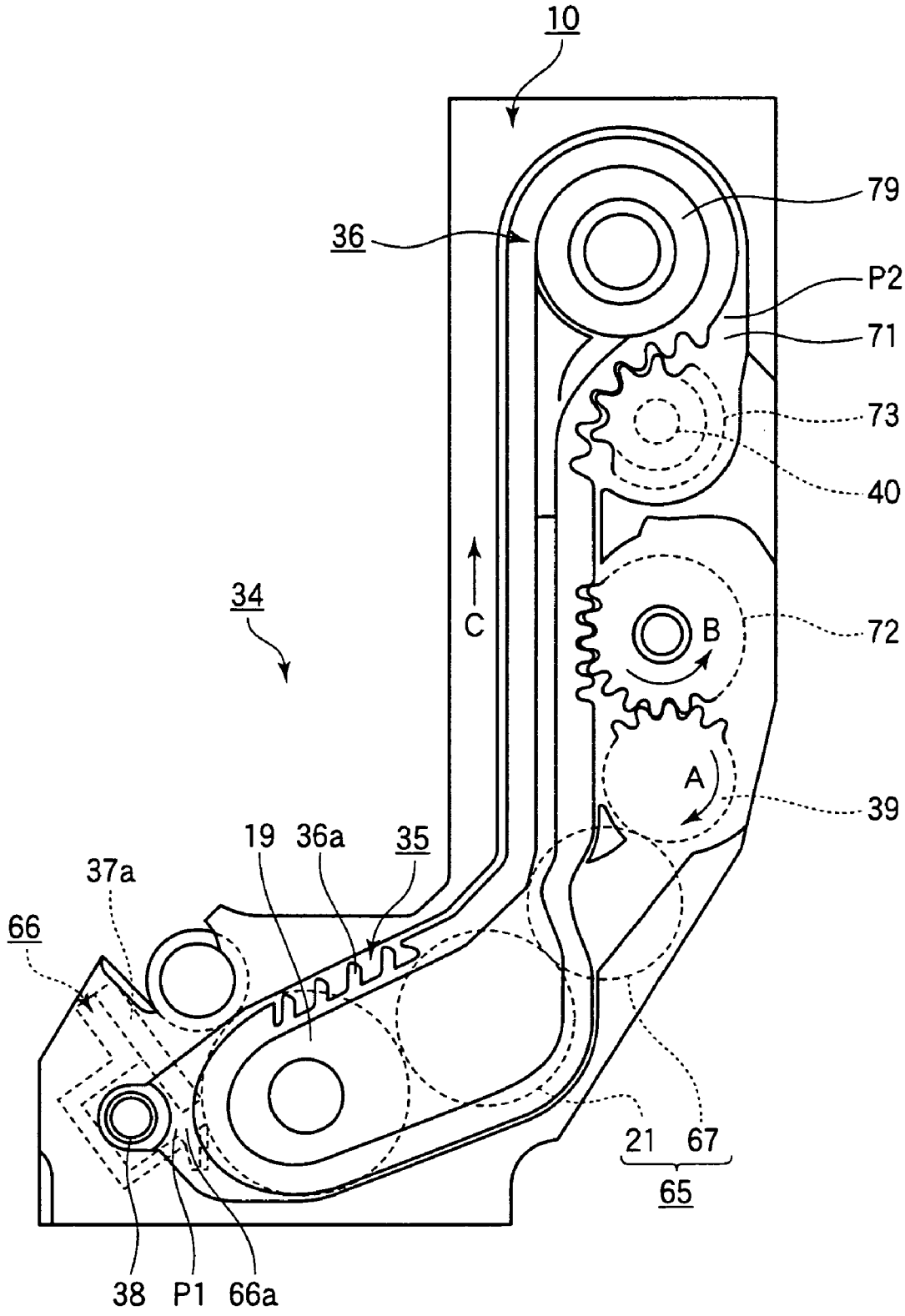
FIG. 20 is a side view of a conventional process cartridge.
Figure 21:
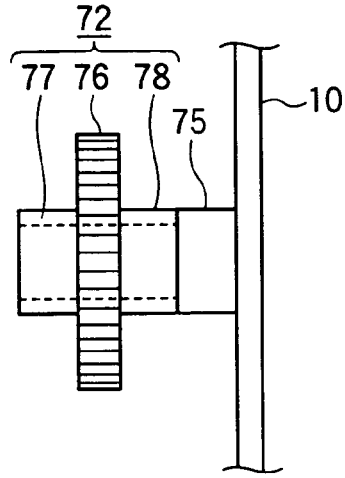
FIG.21 CONVENTIONAL ART
FIG. 21 is a side view of a shaft-supporting structure for a conventional belt-driving gear.
Figure 22:
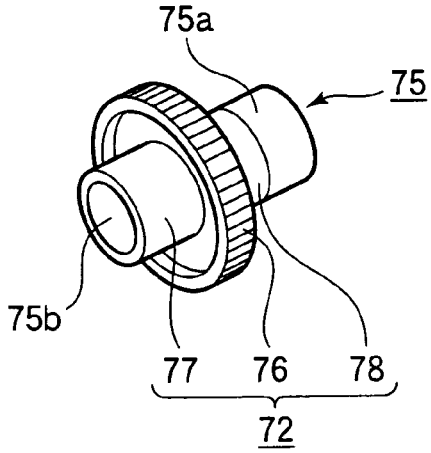
FIG.22 CONVENTIONAL ART
FIG. 22 is a perspective view of a conventional gear.
Figure 23:
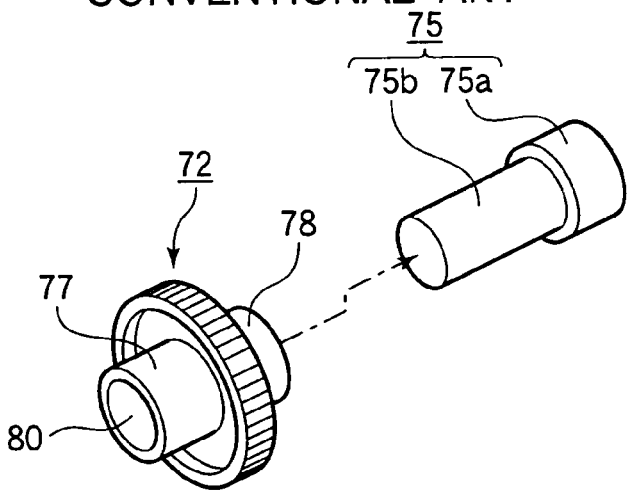
FIG.23 CONVENTIONAL ART
FIG. 23 is an exploded view of FIG. 22.
Figure 24:
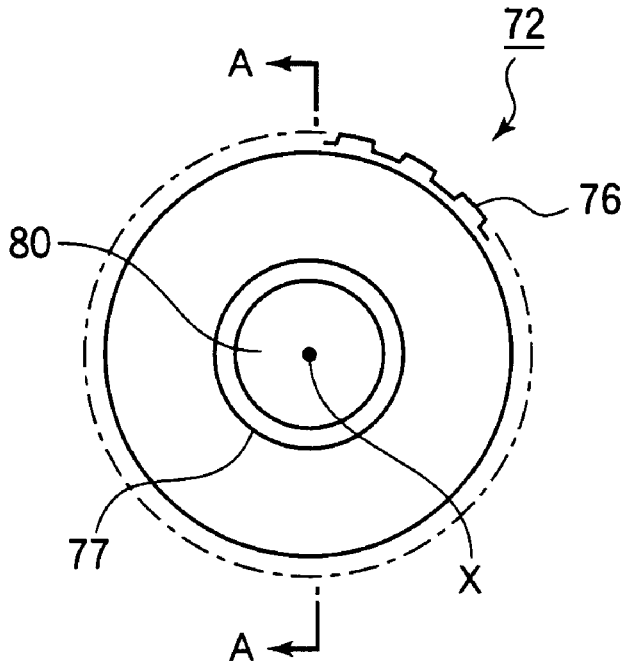
FIG.24 CONVENTIONAL ART
FIG. 24 is a front view of the gear in FIG. 22.
Figure 25:
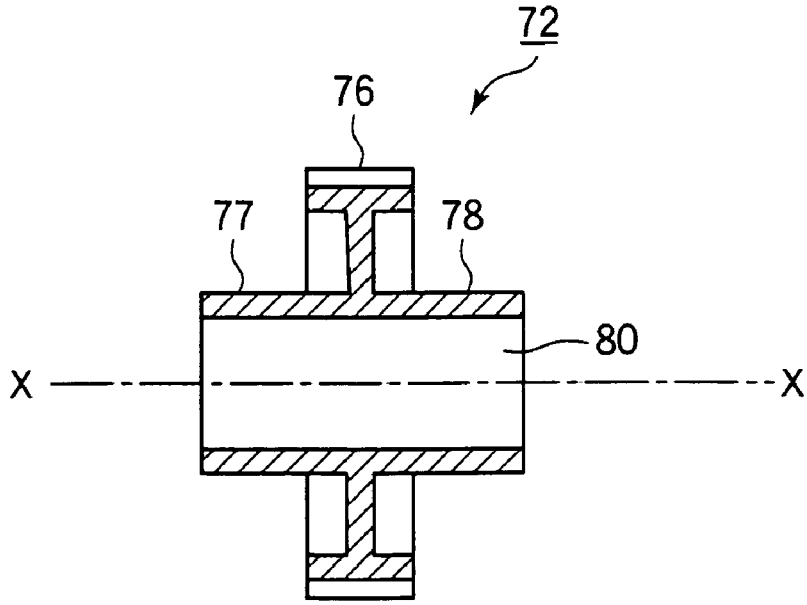
FIG.25 CONVENTIONAL ART
FIG. 25 is a cross-sectional view taken along line A—A of FIG. 24.

FIG. 19 is a partially cross-sectional view of the resilient sleeve having a low hardness, illustrating the resilient sleeve when it is bent.

Referring to the figures, a solid resilient sleeve 281 is in the shape of a hollow cylinder and fits over the large-diameter portion 285*a*. The boss 288 has a tapered outer surface u. The solid resilient sleeve 281 also covers an end portion of the boss 288, so that the boss 288 is in slidable contact with the resilient sleeve 281 and rotates relative to the resilient sleeve 281. Because the resilient sleeve 281 fits over the boss 288, the torque required for rotating the gear 282 increases slightly but this can be overcome by proper design of the outer diameter of the boss 288.

The resilient sleeve 281 has a small rigidity if it has a low hardness and a small resiliency if it has a high hardness. The hardness of the resilient sleeve 281 according to the fourth embodiment is preferably in the range of 20 to 90° ISO (International Organization for Standardization).

Before the resilient sleeve 281 is fitted over the shaft 285, the diameter of the resilient sleeve 281 is smaller than that of the large-diameter portion 285*a* and larger than that of the small-diameter portion. Thus, if the resilient sleeve 281 has a low hardness, when the resilient sleeve 281 is assembled to the shaft 285, the tip portion of the resilient sleeve 281 slightly deflates as shown in FIG. 18. This is disadvantageous in that the gear 282 is not only difficult to fit into the gap between the small-diameter portion 285*b* and the resilient sleeve 281, but also causes the tip portion 281*a* of the resilient sleeve 281 to bend as shown in FIG. 19.

For different levels of hardness of the resilient sleeve 281, Table 3 lists workability, filming, and increase in the torque required for rotating the gear 286.

TABLE 3

| hardness (ISO ° ) | workability | filming | increase in torque of the gear (g-cm) |
|---|---|---|---|
| 10 | poor | good | 50 or less |
| 20 | good | good | 50 or less |
| 30 | good | good | 50 or less |
| 40 | good | good | 50 or less |
| 50 | good | good | 50 or less |
| 60 | good | good | 50 or less |
| 70 | good | good | 50 or less |
| 80 | good | good | 50 or less |
| 90 | good | good | 50 or less |
| 100 | good | poor | 100 or more |

When the hardness (ISO) is 10°, the workability is poor, filming is not likely to occur, and an increase in the torque required for rotating the gear 286 is 50 g-cm or less. When the hardness is in the range of 10 to 90°, the workability is good, filming is not likely to occur, and an increase in the torque required for rotating the gear 286 is 50 g-cm or less. When the hardness is 100°, the workability is poor, filming occurs, and an increase in the torque required for rotating the gear 286 is 100 g-cm or more.

From the data listed in Table 3, the resilient sleeve 281 has a hardness preferably in the range of 20 to 90°.

The resilient sleeve 281 provides a good sealing effect in comparison to the foamed sleeve 280. Thus, even though the boss 288 is tapered and therefore has a small area in contact with the resilient sleeve 281, the resilient sleeve 281 can function well.

The gear section 286 has 20 teeth with a size of M1 (module 1) and an average thickness of about 1 mm. The outer diameter of the bosses 287 and 288 and the large diameter-portion 285*a* is 8 mm and the outer diameter of the small-diameter portion 285*b* is 6 mm. The tolerance of the diameter of the bosses 287 and 288 is 0/−0.1 mm and the tolerance of the diameter of the large-diameter portion 285*a* is +0.1/0 mm.

The resilient sleeve 281 has a thickness in the range of 0.2 to 1 mm and is made of a foaming material such as urethane or silicone. Too large a thickness loses resiliency. The resilient sleeve 281 having too small a thickness can be made only by a particular processing, thereby increasing the manufacturing cost of the resilient sleeve.

The boss 288 has a tapered surface u having a maximum diameter of 8 mm and a minimum diameter of 7 mm. The distance in an axial direction between the maximum diameter portion and the minimum diameter portion is 2 mm.

In order to evaluate the occurrence of filming, a continuous printing operation of 26,000 pages (9,000 pages at normal ambient temperature and humidity, 9,000 pages at high temperature and high humidity, 8,000 pages at low temperature and low humidity), each page being printed in its entirety at a duty cycle of 5%.

The aforementioned embodiments have been described with respect to a print process cartridge that is capable of collecting residual toner. The present invention is also applicable to a drive system that operates in an environment directly exposed to toner. Among such drive systems is a drive mechanism within a toner cartridge for use in a printer, in which case the drive mechanism include, for example, a rotating toner-agitating shaft and a bearing member on which the toner-agitating shaft is rotatably supported.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner reservoir comprising:

a toner chamber that holds toner therein;

a shaft disposed within said toner chamber and having a groove formed in an outer circumferential surface of said shaft, the groove extending substantially in a first direction in which said shaft extends; and a bearing member that engages said shaft so that said shaft and said bearing member can rotate relative to each other, said bearing member having a projection that projects from said bearing member in a second direction parallel to the first direction, the projection having a surface in contact with said shaft such that the projection rotatably holds said shaft.

2. The toner reservoir according to claim 1, wherein said shaft is stationary and said bearing member rotates on said shaft.

3. The toner reservoir according to claim 1, wherein said bearing member is stationary and said shaft rotatably rotates on said bearing member.

4. The toner reservoir according to claim 1, wherein the projection includes a plurality of walls angularly spaced apart and in contact with said shaft such that said bearing member is rotatably supported on said shaft.

5. The toner reservoir according to claim 4, wherein the walls are present over a total angle in the range of 30 to 70% of 360° with respect to the shaft and absent over a total angle in the range of 70 to 30% of 360° with respect to the shaft.

6. The toner reservoir according to claim 1, wherein the projection is a hollow cylinder having a groove formed in the inner surface, the groove extending substantially in a third direction parallel to the first direction.

7. The toner reservoir according to claim 1, wherein the groove having opposing walls that extend at an angle with the first direction, the opposing walls defining a tapered width of the groove such that the width becomes wider nearer an end of said shaft.

8. The toner reservoir according to claim 7, wherein the opposing walls make the angle not smaller than 11.3° with each other.

9. The toner reservoir according to claim 1, wherein said shaft includes a small-diameter portion and a large-diameter portion, the small-diameter portion supporting said bearing member thereon.

10. A toner reservoir comprising:

a toner chamber that holds toner therein;

a shaft disposed within said toner chamber;

a rotating body rotatably supported on said shaft; and a resilient sleeve that encloses said rotating body and said shaft in such a way that said rotating body is rotatable on said shaft.

11. The toner reservoir according to claim 10, wherein said resilient sleeve is made of a foamed material.

12. The toner reservoir according to claim 11, wherein the foamed material is a closed-cell material.

13. The toner reservoir according to claim 10, wherein the foamed material has a hardness in the range of 20 to 90° ISO.

14. A process cartridge detachably mounted to an image forming apparatus, the process cartridge including a toner chamber and a developing unit that supplies toner to an electrostatic latent image formed on an image bearing body to form a toner image, the process cartridge comprising:

a shaft disposed within said toner chamber and having a groove formed therein, the groove extending substantially in a first direction in which said shaft extends; and a rotating body having walls that project from said rotating body in a second direction parallel to the first direction, the walls being angularly spaced apart and in contact with said shaft such that said rotating body is rotatably supported on said shaft.

15. The process cartridge according to claim 14, wherein the walls are present over a total angle in the range of 30 to 70% of 360° with respect to the shaft and absent over a total angle in the range of 70 to 30% of 360°.

16. The process cartridge according to claim 14, wherein the groove includes opposing walls that extend at an angle with the first direction, the opposing walls defining a tapered width of the groove such that the width becomes wider nearer an end of said shaft.

17. The process cartridge according to claim 16, wherein the opposing walls make an angle not smaller than 11.3° with each other.

18. The process cartridge according to claim 14, wherein said shaft includes a small-diameter portion and a large-diameter portion, the small-diameter portion supporting said rotating body thereon.

19. An image-forming apparatus that forms an image through an image forming process, the image-forming apparatus having a process cartridge according to claim 14.

20. A process cartridge detachably mounted to an image forming apparatus, the process cartridge including a developing unit that supplied toner to an electrostatic latent image formed on an image bearing body to form a toner image, the process cartridge comprising:

a toner chamber that holds toner therein;

a shaft disposed within said toner chamber;

a rotating body rotatably supported on said shaft; and a resilient sleeve that encloses said shaft and a part of said rotating body in such a way that said rotating body is rotatable on said shaft.

21. The process cartridge according to claim 20, wherein said resilient sleeve is made of a foamed material.

22. The process cartridge according to claim 21, wherein the foamed material is a closed-cell material.

23. The process cartridge according to claim 20, wherein said resilient sleeve has a hardness in the range of 20 to 90° ISO.

24. An image-forming apparatus that forms an image through an image forming process, the image-forming apparatus having a process cartridge according to claim 20.

* * * * *